US006325261B1

(12) United States Patent
Webber

(10) Patent No.: US 6,325,261 B1
(45) Date of Patent: Dec. 4, 2001

(54) CAULKING GUN HOLDER

(76) Inventor: Paul Hackett Webber, P.O. Box 114, Rio Nido, CA (US) 95471

( * ) Notice: Subject to any disclaimer, the term of this patent is extended or adjusted under 35 U.S.C. 154(b) by 0 days.

(21) Appl. No.: 09/481,095

(22) Filed: Jan. 11, 2000

(51) Int. Cl.[7] ..... A45F 5/00

(52) U.S. Cl. ..... 224/251; 224/677; 224/679; 224/680; 224/904

(58) Field of Search ..... 224/904, 251, 224/249, 676–680, 660, 674, 148.7, 919, 627, 645, 610–613

(56) References Cited

U.S. PATENT DOCUMENTS

| | | | | |
|---|---|---|---|---|
| 717,646 | * | 1/1903 | Williams | 224/610 |
| 986,573 | * | 3/1911 | Jackson | 224/647 |
| 1,147,419 | * | 7/1915 | Mochida | 224/611 |
| 4,830,247 | * | 5/1989 | Banks | 224/904 X |
| 4,878,606 | * | 11/1989 | Miller | 224/610 X |
| 5,302,302 | * | 4/1994 | Shelley et al. | 224/148.7 X |
| 5,385,281 | * | 1/1995 | Byrd | 224/148.7 X |
| 5,568,887 | * | 10/1996 | Gollihue et al. | 224/904 X |
| 5,609,283 | * | 3/1997 | Harrison, Jr. | 224/904 X |
| 5,695,104 | * | 12/1997 | Darling | 224/904 X |
| 5,934,530 | * | 8/1999 | Antczak et al. | 224/919 X |
| 5,943,696 | * | 8/1999 | Walker | 224/904 X |
| 6,073,823 | * | 6/2000 | Gordan | 224/684 X |

* cited by examiner

*Primary Examiner*—Gregory M. Vidovich
(74) *Attorney, Agent, or Firm*—Risto A. Rinne, Jr.

(57) ABSTRACT

An apparatus for the support of a caulking gun includes an opening at a top-end thereof adapted to receive the caulking gun. A ring defines the opening, according to a first embodiment and a sock portion is attached to the ring and extends therefrom a predetermined distance. A belt loop is attached to the apparatus and is used to attach it to a belt of a user. A cup is disposed distally from the opening under a tip of the caulking gun and is used to catch and retain any caulk that may drip from the gun. The cup is either periodically cleaned and re-used or disposed of, as desired, and a new one inserted. The cup is secured in place by a VELCRO fastener system. The sock portion is preferably made of canvas and includes a second opening at a distal end thereof and a second VELCRO fastener at said distal end to secure the second opening in a closed position. According to a modification, the ring portion is extended into a cylinder and a sleeve to hold a plunger and a pouch to hold a retractable knife are each attached to the cylinder. An extension, similar to the sock portion but shorter in length, is attached to the cylinder, as desired, for use with conventional types of caulking guns.

6 Claims, 2 Drawing Sheets

CAULKING GUN HOLDER

BACKGROUND OF THE INVENTION

1. Field of the Invention

The present invention, in general relates to tool holders and, more particularly, to holsters and pouches adapted to hold a caulking gun.

Caulking guns squeeze caulk out of a tube. There are two standard sizes of tube, one for smaller tasks or for home use and a larger size that is often used by professional contractors.

Prior types of caulking guns maintain pressure on the contents of the tube even after the "trigger" is released, and thereby dispense an additional quantity of caulk. This excess caulk can drip and cause harm to the objects it may inadvertently fall upon make contact with.

Accordingly, a device to safely contain any excess caulk that may tend to drip from the caulking gun is desirable and useful.

There are certain types of newer caulking guns that are called "dripless". These types of guns release pressure from the contents of the tube the moment the trigger is released and are less prone to dripping caulk than prior types of guns. However, even these "dripless" caulking guns may leak or drip a small amount of caulk at times, such as when the contents of the tube is warm and less viscous.

Also, certain types of caulk may react with the surface causing considerable harm thereto if even a small amount is allowed to contact the surface. Certain adhesives that are dispensed from caulking guns require special care and the user must be especially careful to ensure that not even a small quantity is able to drip where it is not wanted.

Therefore, with even dripless types of more modern caulking guns, it is advantageous to ensure that they cannot drip caulk (or adhesives, etc.) where they are not desired.

A further need is to be able to open the end of the tube of caulk or adhesive. Some caulking guns contain a metal plunger and some even contain a method to cut the tip off of the tube of caulk.

One problem is that the tip of the tube can become clogged during use (as the caulk at the tip begins to dry). If the user relies upon the metal plunger built into the caulking gun to clear the clog, he must remove the tube of caulk from the gun itself. This takes time and requires two hands to accomplish. This is difficult if the user is, for example, high up a ladder.

Another problem is that the devices that are built into caulking guns to cut the tip of the tube off do not allow for much latitude whereby the user can cut off a large amount of the tip of the tube of caulk such as he would wish to do if he is to dispense a large amount of caulk in a small area (such as to fill a void). Also, the user must again remove the tube of caulk from the gun if he wishes to cut the tip off of the tube or even if he wants to attempt to force a larger cut.

Therefore, it is desirable to be able to clear clogs and cut the tip off of the tube of caulk when the tube remains attached and ready for use in a caulking gun. It is also desirable to be able to cut the tip off of the tube of caulk at any preferred size.

Accordingly there exists today a need for a caulking gun holder that prevents drips from damaging surfaces and which helps to solve the various aforementioned problems.

Clearly, such an apparatus would be a useful and desirable device.

2. Description of Prior Art

Caulking gun holders are, in general, known. While the structural arrangements of the various known types of devices, at first appearance, may have similarities with the present invention, they differ in material respects. These differences, which will be described in more detail herinafter, are essential for the effective use of the invention and which admit of the advantages that are not available with the prior devices.

OBJECTS AND SUMMARY OF THE INVENTION

It is an object of the present invention to provide a caulking gun holder that prevents drips from falling on the floor or other objects.

It is also an important object of the invention to provide a caulking gun holder that includes a cup to catch drips.

Another object of the invention is to provide a caulking gun holder that includes a holder for a detachable plunger.

Still another object of the invention is to provide a caulking gun holder that includes a holder for a detachable retractable knife.

Still yet another object of the invention is to provide a caulking gun holder that is formed of a preferred material.

Yet another important object of the invention is to provide a caulking gun holder that is formed of canvas.

Still yet another important object of the invention is to provide a caulking gun holder that is formed of plastic.

Briefly, a caulking gun holder apparatus for use with a caulking gun that is constructed in accordance with the principles of the present invention has a holder that, according to a first embodiment, is adapted to hold a caulking gun and tube of caulk disposed therein in a sock. The sock is formed of any preferred material such as a flexible canvas, leather, or a rigid plastic and includes a disposable cup at the end thereof. The sock is open at both ends and the cup is secured at the bottom by a closure that is attached to the sock. According to a second embodiment, a holder includes a cylinder portion and a loop for attachment to a belt and a sleeve to hold a detachable metal plunger and a pouch to hold a retractable knife, both of which are attached to the cylinder portion.

DETAILED DESCRIPTION OF THE INVENTION

Figure 1:
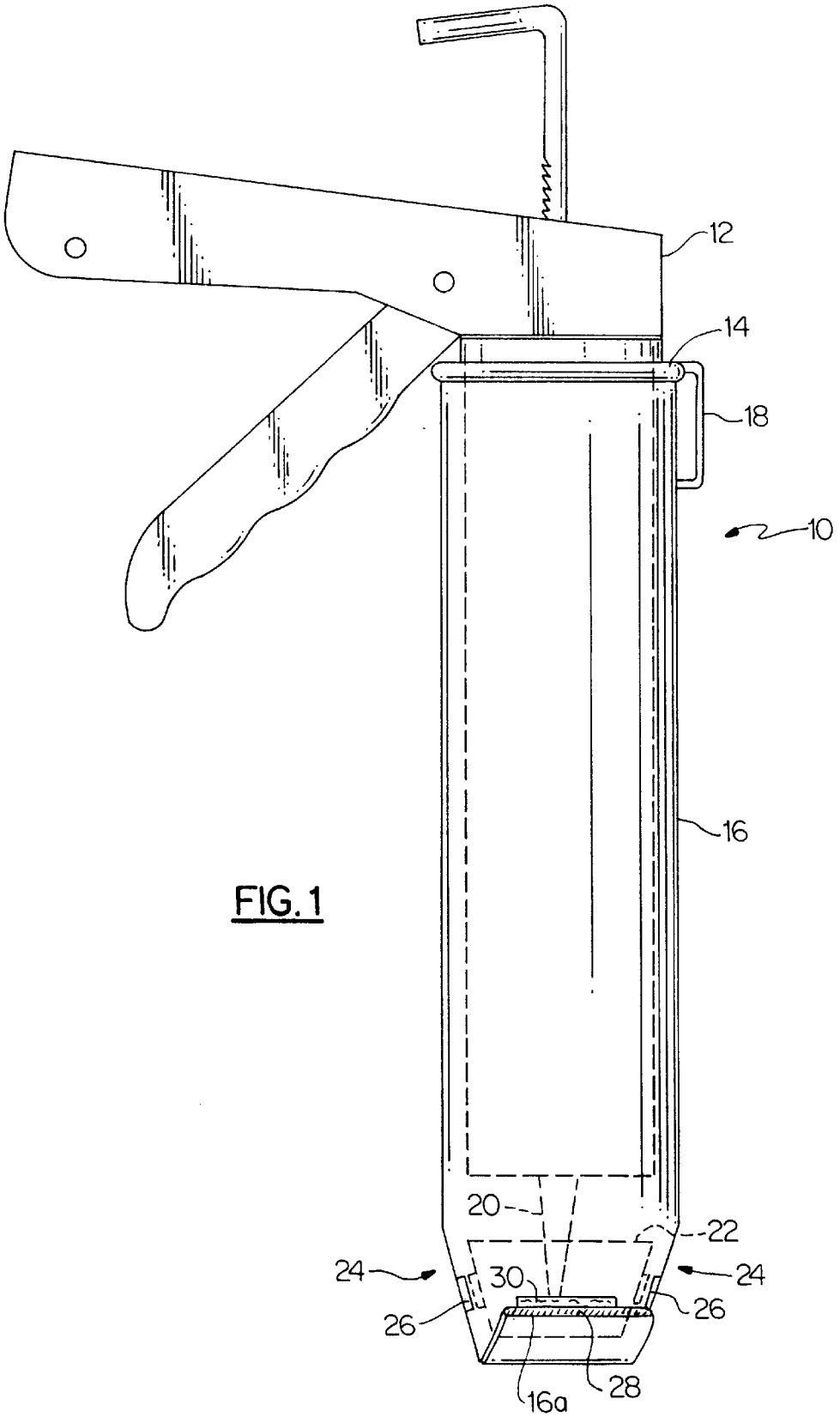
FIG. 1 is a view in perspective of a first embodiment of a caulking gun holder.

Referring to FIG. 1 is shown, a caulking gun holder, identified in general by the reference numeral 10.

A caulking gun 12 fits into the holder 10. The holder 10 includes a ring 14 at the top at one end thereof and a sock portion 16 attached to the ring 14 and extending therefrom a predetermined distance sufficient to accommodate the size of the caulking gun 12.

The sock portion 16 is made of any preferred material and is open at the end that is attached to the ring 14. The sock portion 16 may be flexible or rigid, made of a cloth or a plastic, or the like. A particularly advantageous material to use for the construction of the sock portion 16 is canvas cloth, as it is washable and durable, however, leather is also a good choice as it is especially durable.

A belt loop 18 is attached to either the ring 14 or the sock portion 16 and is used to suspend the holder 10 from a belt (not shown) that is worn by a user (not shown).

The caulking gun 12 includes a tip 20, from which caulk (not shown) is expelled under pressure and which can drip when the gun 12 is placed in the holder 10.

A cup 22 is disposed in the sock portion 16 so as to be disposed under the tip 20 of the gun 12. The cup. 22 may be secured in a proper position by a taper 24 of the sock portion 16 or by a first hook and loop fastener 26, one half of which being attached to the sock portion 16 and the remaining half being attached to the cup 22. The first fastener 26 is typically sold under the tradename of VELCRO.

The sock portion 16 includes an opening 28 at a distal end 16*a* furthest from the ring 14 that is useful for removing the cup 22 and for cleaning, in general.

The distal end 16*a* includes a second hook and loop fastener 30, one half of which is attached to the distal end 16*a* and the remaining half being attached to the sock portion 16 proximate the distal end 16*a*.

To close off or seal the distal end 16*a,* it is lifted slightly up and back so that the two halves of the second hook and loop fastener 30 make contact with each other and retain the distal end 16*a* in an elevated position.

Other methods to seal the distal end 16*a* or to retain the cup 22 are anticipated, however, those herein disclosed represent the best mode presently contemplated for bringing forth the invention with a flexible sock portion 16.

Figure 2:
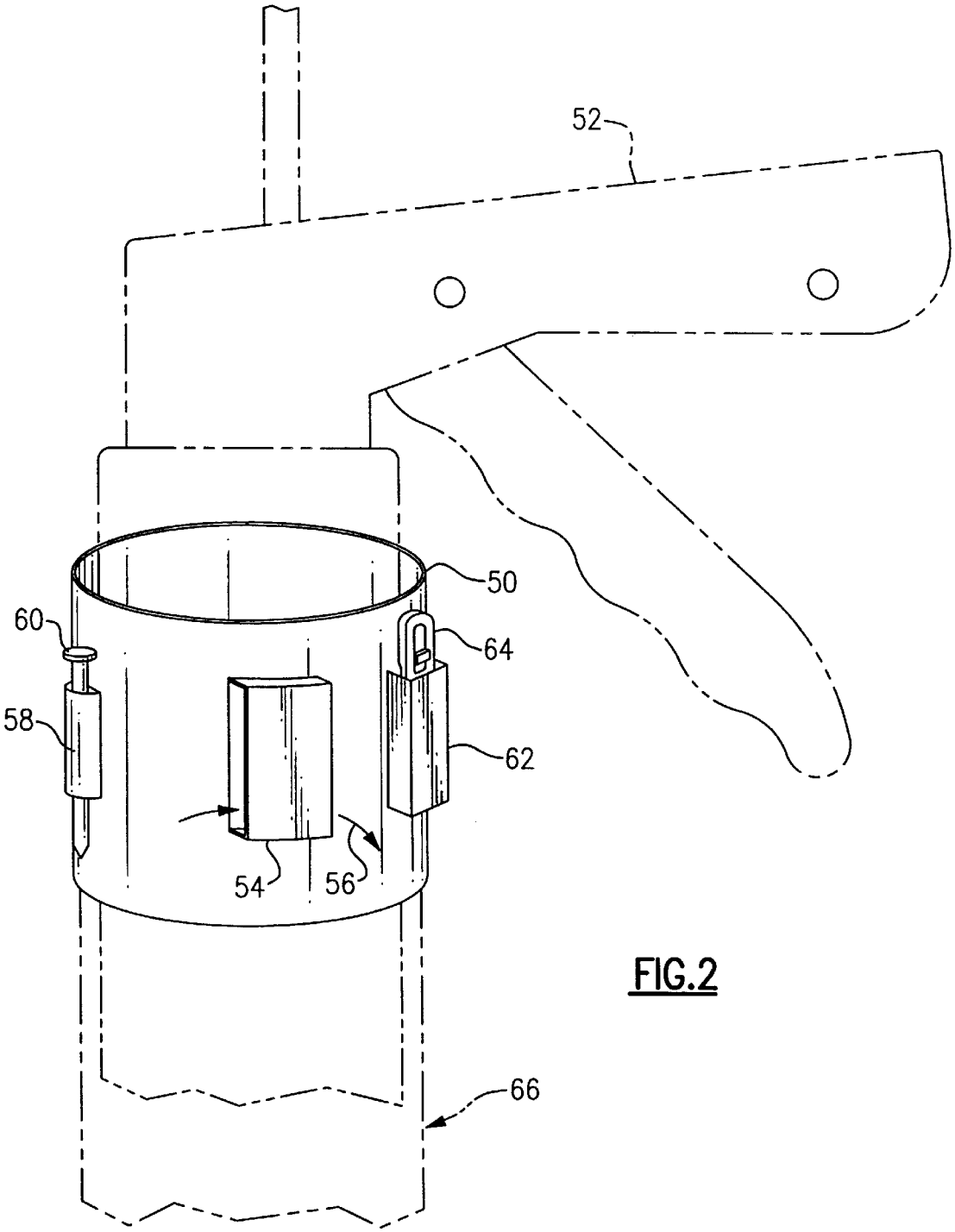
FIG. 2 is a view in perspective of a second embodiment of a caulking gun holder.

Referring now to FIG. 2, a second modified embodiment is shown. A modified holder 50 is preferably formed of a rigid material such as a plastic, into which a caulking gun 52 (dashed lines) is inserted. The modified holder 50 is a cylindrical structure having dimensions suitable for use as described in greater detail hereinafter.

The modified holder 50 includes a modified belt loop 54, into which the belt (not shown) can be inserted along the path indicated by arrow 56.

The modified holder 50 includes a sleeve 58 that is intended to hold a metal plunger 60, useful to open a tube of caulk (not shown).

The modified holder 50 includes a pouch 62 that is open at the top and sealed at the bottom that is intended to hold a retractable knife 64.

The remainder of the gun 52 extends down below the modified holder SO. Only a portion of the gun 52 is shown extending below the modified holder 50.

An optional extension, identified in general by the reference numeral 66 and shown in dashed lines, is attached to the modified holder 50 as desired. The extension 66 is similar to the sock portion 16 previously described and is used when the modified holder 50 is to be used with caulking guns 52 that are prone to dripping caulk.

If a dripless type of a caulking gun is used, the extension portion 66 may be omitted from the modified holder 50.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A caulking gun holder for use with a caulking gun, said holder adapted to be supported by a belt of a user, comprising:

(a) means for supporting said caulking gun, wherein said means for supporting includes a ring adapted for defining an opening that is adapted to receive said caulking gun therein and wherein said ring includes a shock having an open end and a distal end, and wherein said open end is attached to said ring and wherein said sock extends therefrom a predetermined distance to said distal end and wherein said sock is formed of flexible fabric material and wherein said open end is adapted to provide access to an interior of said sock sufficient to place at least a portion of said caulking gun therein and wherein said distal end includes a second opening and wherein said second opening includes means for placing said second opening in a first closed position and, alternatively, in second open position;

(b) means for attaching said means for supporting to said belt; and (c) a cup that is detachably-attachable with respect to said sock, and wherein said cup is adapted to be disposed under a tip of said caulking gun proximate said distal end whereby said cup is adapted to retain a quantity of caulking material that is discharged from said tip of said caulking gun.

2. The caulking gun holder of claim 1 wherein said means for attaching includes a belt loop attached to said holder.

3. The caulking gun holder of claim 1 wherein said cup includes means for attaching said cup to said sock.

4. The caulking gun holder of claim 1 wherein said means for placing said second opening in said first closed position includes means for securing said distal end to a portion of said sock elevated above said distal end whereby said second opening is disposed in said first closed position when said distal end is secured to said portion of said sock that is elevated above said distal end.

5. The caulking gun holder of claim 4 wherein said means for securing includes a first portion of a hook and loop fastener attached to said distal end and a second portion of a hook and loop portion attached to said sock portion a predetermined distance from said distal end.

6. The caulking gun holder of claim 1 wherein said flexible fabric material includes a canvas cloth.

* * * * *